United States Patent [19]

Grabbe et al.

[11] Patent Number: 4,695,111

[45] Date of Patent: Sep. 22, 1987

[54] ZERO INSERTION FORCE CONNECTOR HAVING WIPING ACTION

[75] Inventors: Dimitry Grabbe, Middletown; Iosif Korsunsky, Harrisburg; Thomas M. Klunk, Dover; Joseph S. DiOrazio, Harrisburg, all of Pa.

[73] Assignee: AMP Incorporated, Harrisburg, Pa.

[21] Appl. No.: 849,980

[22] Filed: Apr. 10, 1986

[51] Int. Cl.[4] ..... H01R 9/09

[52] U.S. Cl. ..... 439/266; 439/260; 439/325; 439/630

[58] Field of Search ..... 339/74 R, 75 MP, 176 MP, 339/252 R

[56] References Cited

U.S. PATENT DOCUMENTS

| | | | |
|---|---|---|---|
| 3,654,592 | 4/1972 | Primorac | 339/176 MP |
| 3,899,234 | 8/1975 | Yeager et al. | 339/74 R |
| 3,982,807 | 9/1976 | Anhalt et al. | 339/75 MP |
| 4,017,135 | 4/1977 | Taguchi | 339/176 MP |
| 4,303,294 | 12/1981 | Hamsher, Jr. et al. | 339/74 R |
| 4,487,468 | 12/1984 | Fedder et al. | 339/75 MP |
| 4,553,804 | 11/1985 | Lapraik et al. | 339/74 R |

FOREIGN PATENT DOCUMENTS

| | | | |
|---|---|---|---|
| 2802800 | 7/1978 | France | 339/176 MP |
| 2133938 | 8/1984 | United Kingdom | 339/176 MP |
| 723704 | 4/1980 | U.S.S.R. | 339/176 MP |

*Primary Examiner*—John McQuade

*Attorney, Agent, or Firm*—Bruce J. Wolstoncroft

[57] ABSTRACT

A multicontact electrical connector comprises an insulating housing having a substrate-receiving face. A trough-like opening extends into the face for reception of a substrate. In the housing are spaced-apart terminals having free ends which are proximate to the substrate-receiving face and fixed ends which are proximate to an inner end of the opening. Contact surfaces are on the free ends for contacting spaced-apart terminal pads on the substrate. Contact engagement camming means are provided for flexing the terminals and moving the free ends from the opening allowing the substrate to be placed in the opening under reduced insertion force conditions. As the free ends of the terminals are subsequently moved, the contact surfaces of the free ends will be resiliently biased against the terminal pads. Contact wipe camming means are provided to move the contact surfaces across the terminal pads as normal force occurs permitting a wiping action to take place. A locking means is provided to hold the substrate in place as the wiping action occurs. This assures that the contact surfaces and the terminal pads, where engagement therebetween takes place, are cleaned and a positive electrical connection is effected.

16 Claims, 12 Drawing Figures

ZERO INSERTION FORCE CONNECTOR HAVING WIPING ACTION

FIELD OF THE INVENTION

This invention relates to a multicontact electrical connector of the reduced insertion force type which allows for a wipe action to occur when the terminal is exerting maximum normal force on the substrate, thereby insuring a positive electrical connection.

BACKGROUND OF THE INVENTION

Low insertion force connectors (LIF) and zero insertion force connectors (ZIF) are well known in the industry. Many of these reduced insertion force connectors have similar design characteristics. Each connector has a housing with an opening in one side of the housing to allow for the insertion of the substrate. At the time of insertion, terminal members inside the housing have been displaced from the substrate opening, allowing the substrate to meet minimal resistance as it is inserted into the housing. After the substrate has been fully inserted the terminals are permitted to move back towards the opening causing contact portions of the terminal to be resiliently engaged with terminal pads on the substrate. This operation assures a secure connection but does little to guarantee a positive electrical connection.

Recently a few connectors have addressed this problem. These connectors allow the terminals to produce an incidental wipe as the terminals engage the terminal pads on the substrate. The wipe action that occurs in these type of connectors is an improvement over the original reduced insertion force connectors. However, the wipe action takes place when the terminals are not exerting maximum normal forces on the terminal pads. In fact, as the wipe action begins only minimal forces are being exerted by the terminals on the terminal pads. In many instances this incidental wipe action is not enough to allow the contact area of the terminal to penetrate the corrosive film or other impurities present on the terminal pads. Therefore, a positive electrical connection is still not guaranteed. The present invention is directed to the achievement of a connector which will allow reduced insertion force and guarantee that the wiping action will occur at maximum normal force, insuring a positive electrical connection.

THE INVENTION

The invention comprises a multicontact electrical connector, each of the connectors being of the type comprising an insulating housing having a substrate-receiving face. A trough-like opening extends into the face for reception of an edge portion of the substrate. The substrate has oppositely facing major surfaces and spaced-apart terminal pads located on at least one of the surfaces at the edge portions. The opening has an opening sidewall which is opposed to the substrate surface when the substrate is placed in the opening. In the housing and adjacent to the opening sidewalls are spaced-apart terminals, each having a free end which is proximate to the substrate-receiving face and a fixed end which is proximate to an inner end of the opening. A contact portion is on the free end and is for contacting a terminal pad on the substrate. End portions of the terminal, including the contact portion and the free end, extend into the opening when the terminal is in an unflexed condition. Contact engagement camming means are provided for flexing the terminal and moving the end portions from the opening allowing the substrate to be placed in the opening under zero insertion force conditions. As the terminal is subsequently unflexed the end portions will be resiliently biased against the terminal pads.

The connector is characterized in that contact wipe camming means are provided on each terminal and in the housing for moving the contact portions of the terminals across the terminal pads on the substrate positioned in the opening. The contact wipe camming means comprises a contact wipe cam follower on each of the terminals and a movable camming member. The camming member has contact wipe camming surfaces which are cooperable, upon movement of the camming members, with the contact wipe cam followers on the terminals.

In accordance with further embodiments, the contact engagement camming means consists of a contact engagement cam follower on each of the terminals and a plurality of contact engagement camming surfaces on the camming member. Each of the contact engagement camming surfaces being cooperable with a contact engagement can follower on one of the terminals to flex and unflex the terminals.

In accordance with further embodiments, substrate locking means are provided in the housing for locking the substrate to the housing. This prevents movement of the substrate from the housing during movement of the contact portions along the terminal pads. The substrate locking means comprises locking portions which engage the substrate when the terminals are unflexed and at least one locking key in the housing which is movable between a locking position and an unlocked position. The substrate being locked to the housing when the key is in the locking position.

In accordance with further embodiments an actuator is provided for moving the key between the locking position and the unlocked position and for moving the camming member.

In accordance with further embodiments the terminal is stamped and formed from a resilient sheet metal stock and comprises a shank having a mounting portion at one end and a free end portion at the other end. The terminal is characterized in that a contact arm is struck from the shank and extends from the free end portion. The contact arm has a fixed end which is pivotally attached to the shank and an outer end which comprises the contact portion of the terminal and the contact wipe cam follower.

THE DRAWING FIGURES

THE DISCLOSED EMBODIMENT

Figure 1:
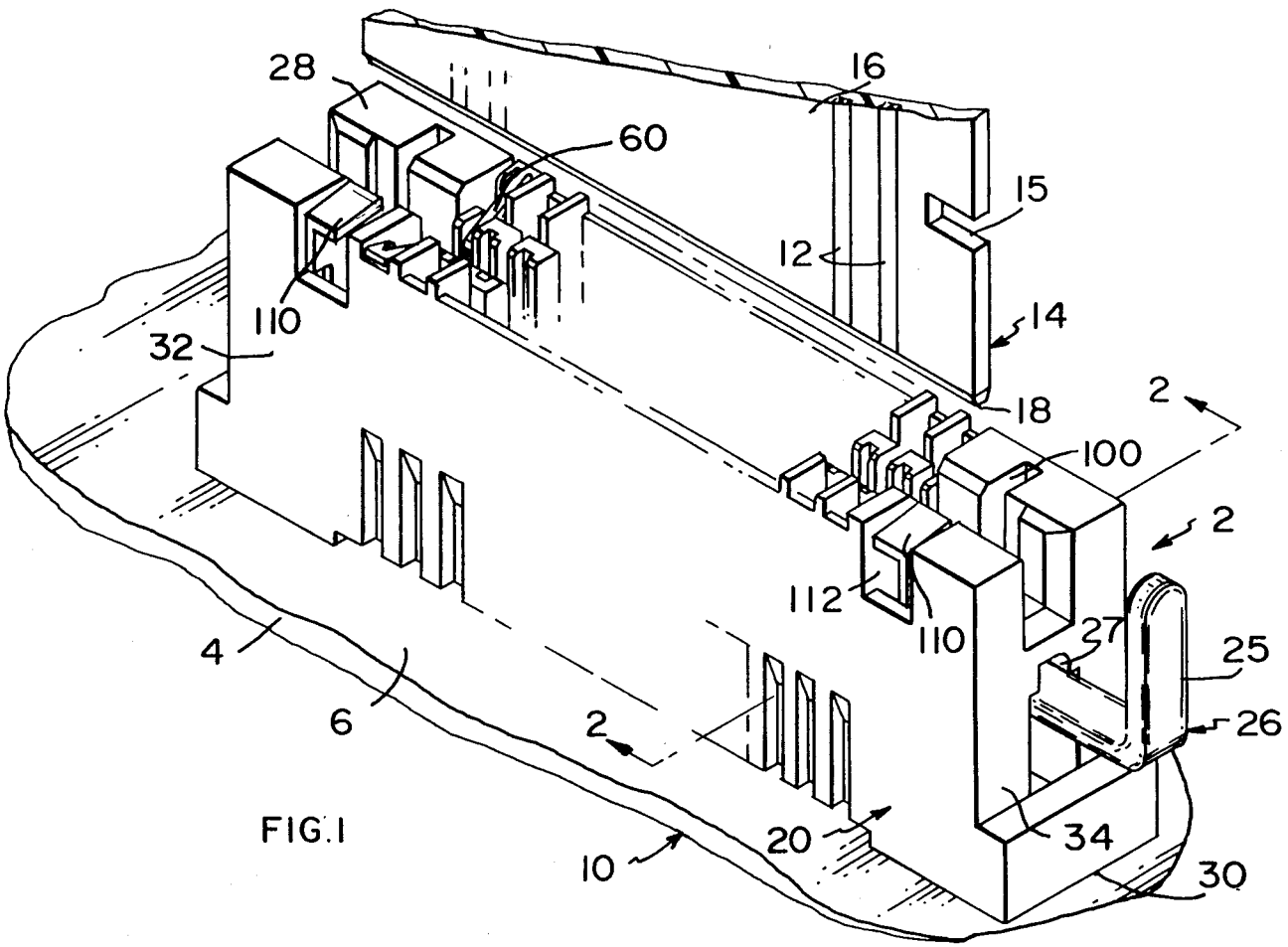
FIG. 1 is a perspective view of a connector assembly in accordance with the invention.

Referring first to FIG. 1, a connector assembly 2, in accordance with the invention, is mounted on an upper surface 6 of a panel 4. The connector assembly 2 is used to connect conductors (not shown) on a lower surface 10 of panel 4 to spaced-apart terminal pads 12 on a substrate 14. The terminal pads 12 are positioned on a lower edge portions 18 of major surfaces 16 of substrate 14.

The connector assembly 2 as best shown in FIGS. 2 through 5 comprises a housing 20 made from a suitable dielectric material, terminals 22 to make contact with the spaced-apart terminal pads 12, a camming block 24 to engage terminals 22, and an actuator 26 for moving camming block 24.

Figure 11:
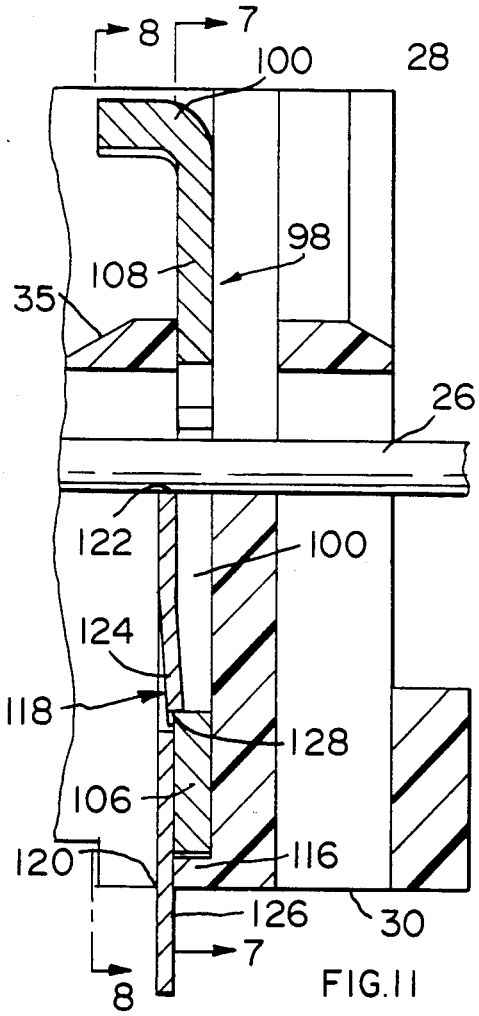
FIG. 11 is a perspective cross-sectional view illustrating the locking keys.
Figure 10:
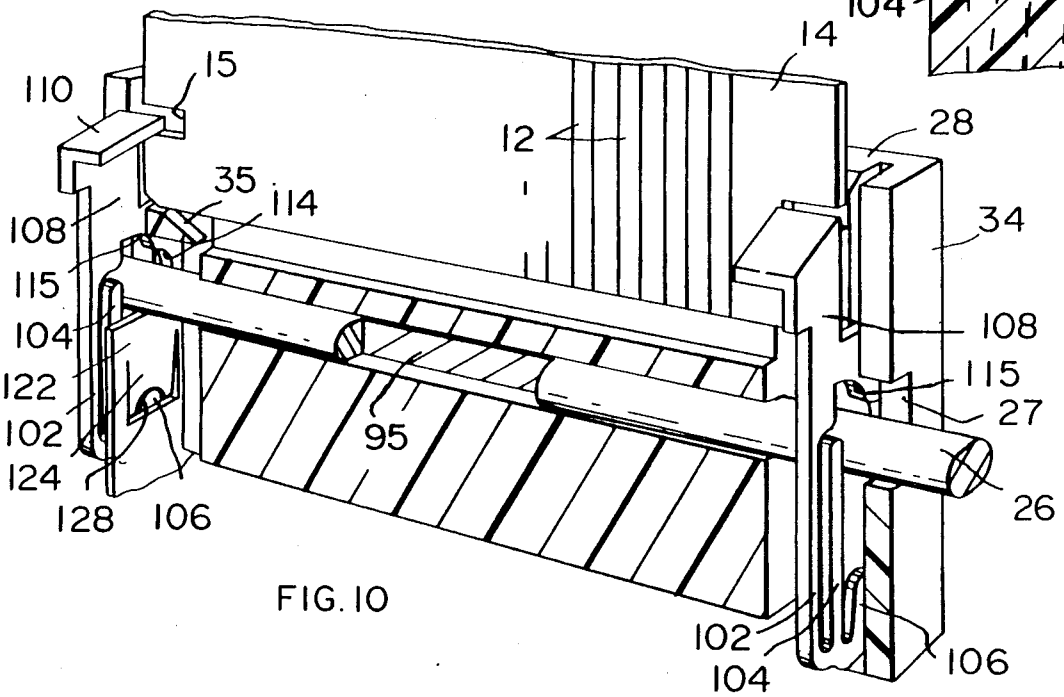
FIG. 10 is a cross-sectional view looking in the direction of arrow 10—10 in FIG. 8 illustrating the locking key.

The housing 20, as shown in FIGS. 1 through 5, has an upper or substrate-receiving surface 28 and a lower or mounting surface 30. Oppositely facing sidewalls 32 and oppositely facing endwalls 34 connect mounting surface 30 to substrate-receiving surface 28. Actuator openings 27 are provided on endwalls 34 and extend inward allowing insertion of actuator 26 as discussed below. Substrate engagement projections 35 extend from sidewalls 32 to support substrate 14 as best shown in FIGS. 10 and 11. An opening 36 extends inwardly from top surface 28 of housing 20 to a central section 38 which supports actuator 26. On either side of central section 38 passageways 40 are located. The lower ends of passageways 40 narrow to form mounting slots 41 while the upper ends merge with terminal-receiving cavities 44. Terminal-receiving cavities 44 extend from passageways 40 to surface 28. Slots 46 of the terminal-receiving cavities 44 extend into sidewalls 32 at upper ends thereof.

Figure 6:
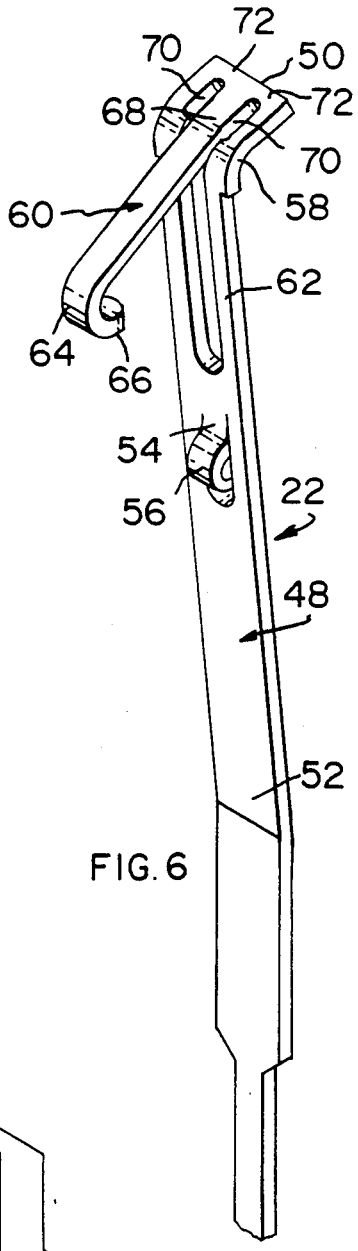
FIG. 6 is a perspective view of a terminal used in the connector.

Each terminal 22, as shown in FIG. 6, is stamped and formed from resilient sheet metal stock and includes a shank 48 having a mounting portion 52 at one end and a top section 50 at the other end. A tongue 54 is struck from the shank 48. The tongue 54 is formed into an arcuate shape at its free end to provide a contact engagement cam follower 56. Above tongue 54 the shank 48 is bent so that the top section 50 is positioned to the side of the shank 48. A portion 62 is located between top section 50 and tongue 54. A contact arm 60 is struck from portion 62. An end 68 of contact arm 60 is attached to section 50 and the outer end of contact arm 60 comprises a radiussed contact surface 64 and a contact wipe cam follower 66. End 68 of contact arm 60 is attached to section 50 by pivot portions 72 which are located in top section 50. Openings 70 are located in section 50 enabling pivot portions 72 to operate properly as discussed below.

Each terminal 22 is inserted into terminal-receiving cavity 44 through surface 28. As terminal 22 is inserted, passageway 40 receives and guides mounting portion 52 into mounting slot 41.

Figure 2:
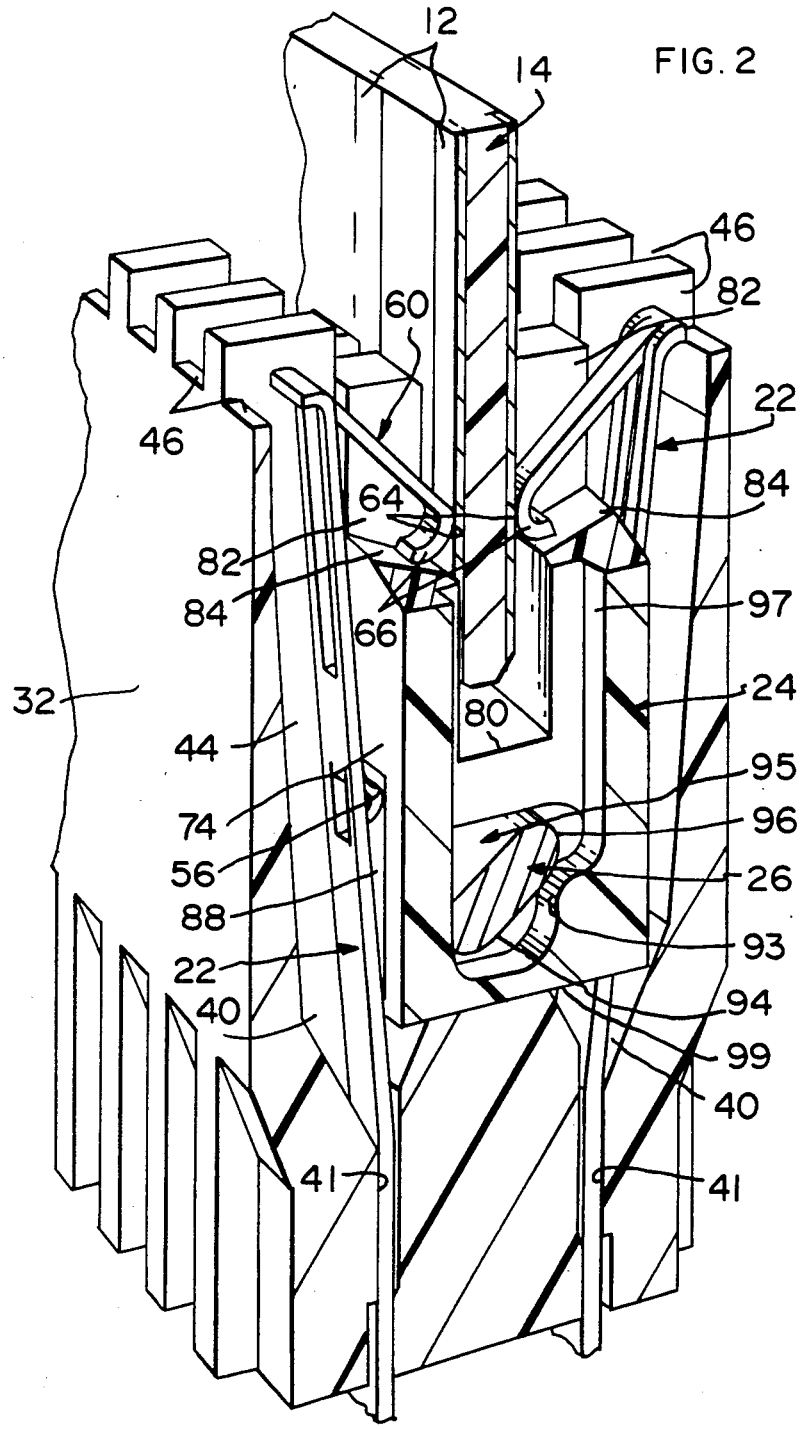
FIG. 2 is a perspective cross-sectional view looking in the direction of arrows 2—2 of FIG. 1.
Figure 3:
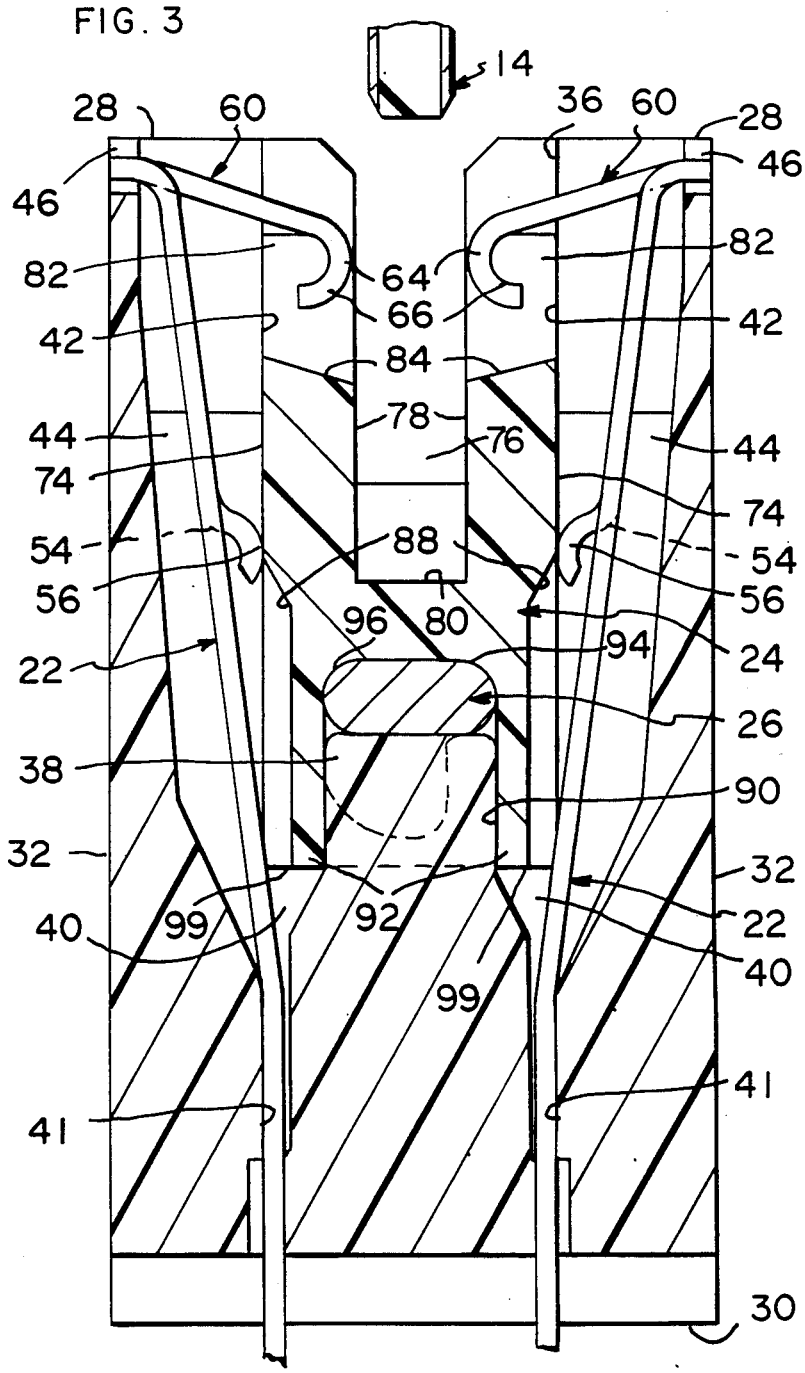
FIG. 3 is an orthographic cross-sectional view also looking in the direction of arrows 2—2 of FIG. 1 showing the parts of the connector in the open position.
Figure 4:
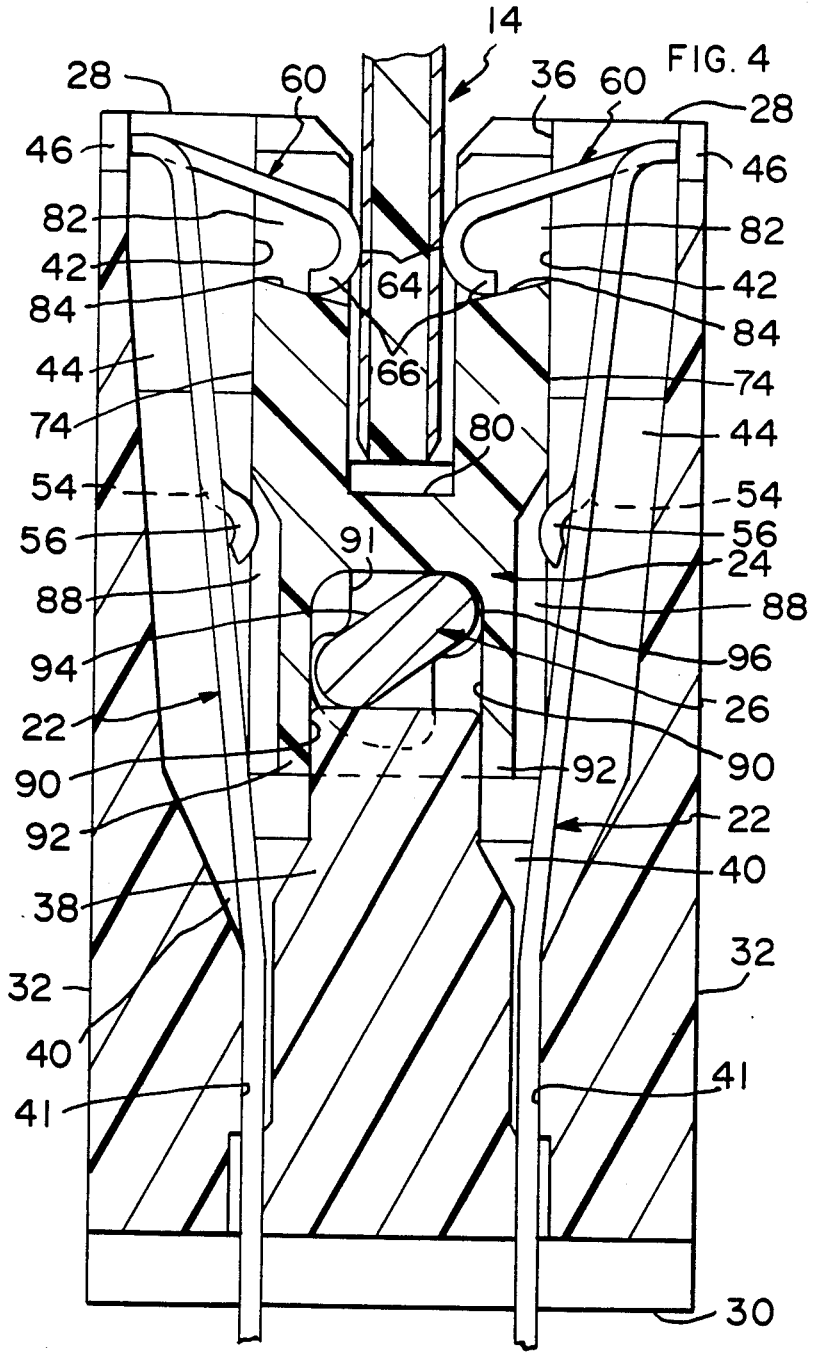
FIGS. 4 and 5 are orthographic cross-sectional views, similar to FIG. 3, illustrating various positions of the parts.

Camming block 24 has side surfaces 74 which slidably move along opening sidewalls 42. The camming block 24 also defines a substrate-receiving channel 76 having channel sidewalls 78 and an inner end 80. The channel 76 must have a greater width than substrate 14. Openings 82 in channel sidewalls 78 are provided and spaced apart in the same manner as are terminals 22 and receive the outer ends of contact arms 60 therein as shown in FIG. 3. Lower ends 84 of openings 82 serve as contact wipe camming surfaces for engagement with cam followers 66. These contact wipe camming surfaces 84 are angled downward from side surfaces 74 to channel sidewalls 78. Side surfaces 74 act as contact engagement camming surfaces against which contact engagement cam followers 56 engage when camming block 24 is in an inoperative position. Adjacent recessed portions 88 in camming block 24 are in alignment with respective terminal-receiving cavities 44 and permit inward movement of terminals 22 as illustrated in FIG. 4 which will be discussed in greater detail below. Recesses 90 (FIG. 3) extend inwardly from a bottom surface 99 of camming block 24 and are spaced in the same manner as recessed portions 88 so as to be in alignment therewith. Legs 92 are positioned on either side of central section 38. The inner surfaces of legs 92 define the sides of recesses 90. Openings 97, shown in FIG. 2, are provided in camming block 24 in the portions of camming block 24 between the recess portions 88. Openings 97 extend from surface 28 to bottom surfaces of openings 97 which are proximate bottom surface 99 of camming block 24. The bottom surfaces of openings 97 are shaped to provide actuator engagement surfaces 93. The surfaces of recesses 90 and actuator engagement surfaces 93 cooperate to define actuator slot 95. Slot 95 extends through camming block 24 and is aligned with openings 27 of endwalls 34 to allow insertion of actuator 26 into connector assembly 2. Periodically-spaced actuator support surfaces 91 are provided in housing 20 and extend into slot 95 for contact with actuator 26. Actuator 26 is positioned in slot 95 and comprises oppositely facing actuator sides 94 and oppositely facing radiussed actuator ends 96.

When actuator 26 is in the position as shown in FIG. 3, the connector assembly 2 is in an open or first position. In this first position, cam followers 56 are in engagement with contact engagement camming surfaces 74 urging the upper ends of terminals 22 outwardly thereby placing terminals 22 in a flexed condition. The flexed condition allows top sections 50 of terminals 22 to be placed in slots 46 of terminal-receiving cavities 44. This enables contact arms 60 to be moved out of the substrate-receiving channel 76 allowing substrate 14 to be placed in the connector assembly 2 with zero insertion force. It should be noted that in this position, contact wipe camming surfaces 84 and contact wipe cam followers 66 are not in engagement.

With substrate 14 now inserted into channel 76 of connector assembly 2 and in engagement with projections 35 as shown in FIG. 10, actuator 26 is rotated via operating member 25 as shown in FIG. 1 in a counter clockwise manner causing camming block 24 to be moved upward without engaging substrate 14. This movement causes the contact engagement cam followers 56 to slide along contact engagement camming surfaces 74 until the camming block 24 is moved upward enough to allow contact engagement cam followers 56 to move into and along respective recessed portions 88. The adjacent recessed portions 88 angle away from sidewalls 32 and allow the contact engagement cam followers 56 to move thereinto and be free of camming surfaces 74 as shown in FIG. 4. When this occurs cam followers 56 no longer exert force on terminals 22 so that terminals 22 move toward their unflexed position. Before the unflexed position is reached, contact surfaces 64 engage terminal pads 12 of substrate 14 preventing terminals 22 from returning to a completely unflexed position.

Figure 5:
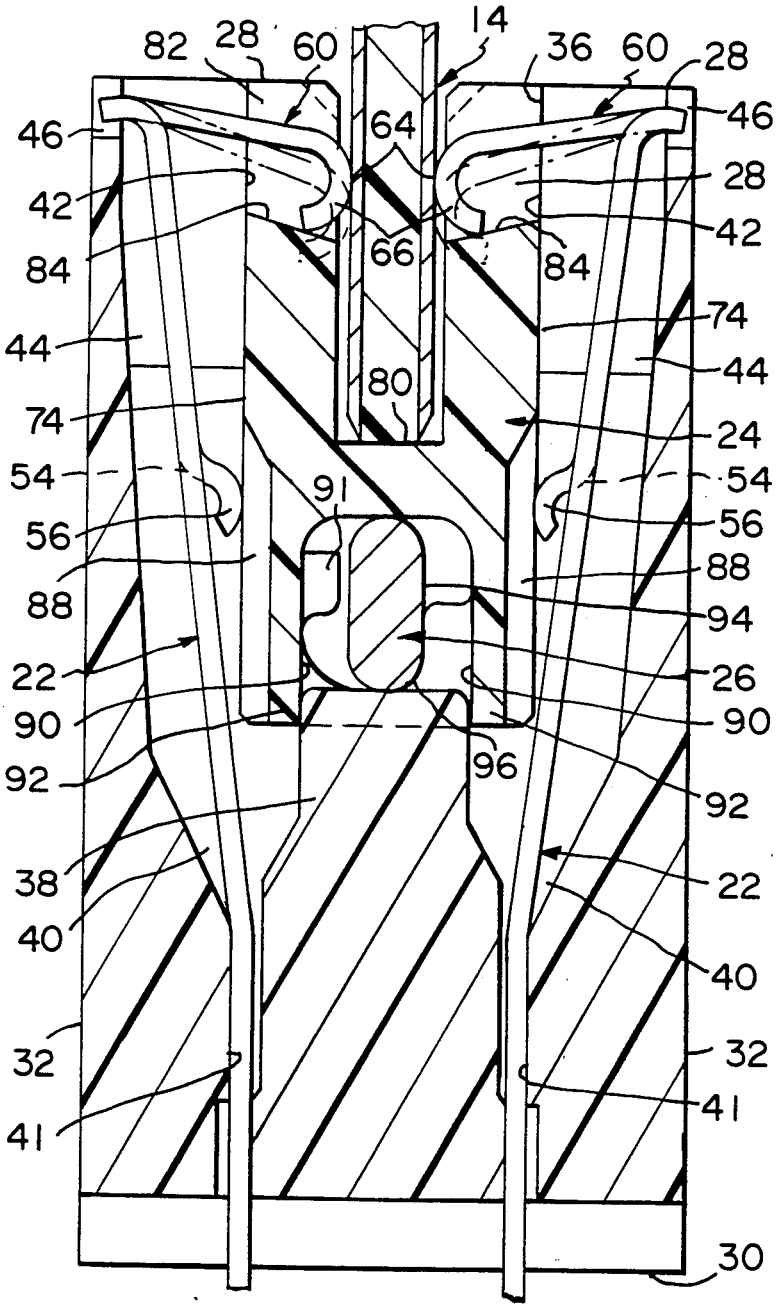

As rotation of actuator 26 continues, contact wipe camming surfaces 84 of camming block 24 engage contact wipe cam followers 66 of contact arms 60 as shown in FIG. 4. Further rotation of actuator 26 forces contact wipe cam followers 66 as well as the rest of contact arms 60 to be moved upward as shown in FIG. 5 as represented by the dotted line to solid line. This action forces contact surfaces 64 to wipingly move across terminal pads 12 which clears terminal pads 12 of any contaminant film which may be present at the point of contact between contact surfaces 64 and terminal pads 12.

The wiping action occurs under ideal conditions due to the unique structure of each terminal 22. The terminal 22, as shown in FIG. 6, is designed so that pivot portions 72 are structurally weaker than the rest of terminal 22. Pivot portions 72 are therefore designed so that they will act as a pivot axis and permit rotation of contact arm 60 when a force is applied against cam follower 66. As contact arm 60 is moved, pivot portions 72 are twisted thereby generating torque forces in pivot portions 72. When movement of contact 60 ceases, the force applied to pivot portions 72 will return contact arm 60 to its original position.

The configuration of terminals 22 allows the wiping action to occur when maximum normal force is being applied by the terminals 22 on the terminal pads 12. The wiping action of contact surfaces 64 across terminal pads 12 does not occur until the terminals 22 are exerting normal force on terminal pads 12. This assures that the contact surfaces 64 and terminal pads 12 where engagement therebetween takes place are cleaned and a positive electrical connection is effected.

As actuator 26 is returned from the second position to the first position (FIG. 5 to FIG. 3), actuator 26 engages actuator support surface 91 and actuator engagement surface 93 (FIG. 2). The combination of actuator 26 engaging both surfaces 91 and 93 enables actuator 26 to return camming block 24 to the first position as shown in FIG. 3. However, contact arms 60 remain in the position shown in FIG. 5 until the tapered surfaces of recessed portions 88 engage cam followers 56 and then cam followers 56 slide along contact engagement camming surfaces 74. As this occurs terminals 22 are forced to return to their original flexed condition as shown in FIG. 3. Contact surfaces 64 disengage from terminals pads 12 allowing the torque forces in pivot portions 72 to return contact arms 60 to their original position. When actuator 26 is returned to the first position, all other parts of connector assembly 2 are returned to their original positions.

Figure 7:
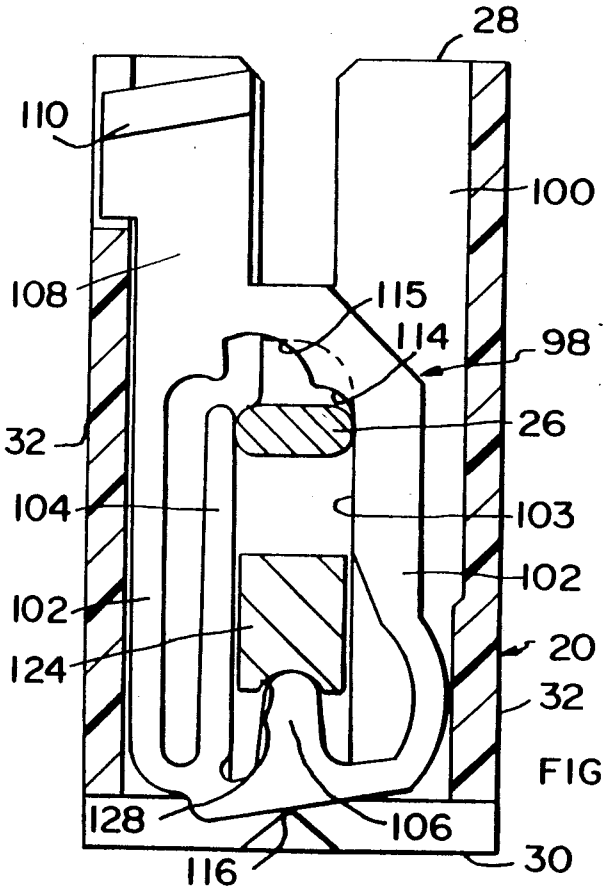
FIG. 7 is an orthographic cross-sectional view looking in the direction of arrows 7—7 of FIG. 11 showing a substrate locking key in the unlocked position.

Locking keys 98, FIGS. 7 through 10, are also provided in connector assembly 2. Locking keys 98 are positioned in locking key slots 100 which are positioned at each end of housing 20, parallel and proximate endwalls 34. Locking slots 100 extend from surface 28 to mounting surface 30 as shown in FIG. 7.

Each locking key 98 comprises a main portion 102, a neck portion 108 extending from main portion 102, and an ear portion 110 extending from neck portion 108. The main portion 102 has an opening 103 therein. An arm 104 extends from a bottom surface of opening 103 of main portion 102 into opening 103. Arm 104 is parallel to sidewalls 32 of housing 20 when actuator 26 is in the first position (FIG. 7). Arm 104 is offset from the vertical axis of locking slot 100. A pivot member 106 is adjacent arm 104 and extends into opening 103. Pivot member 106 is positioned along the vertical axis of locking slot 100. An actuator engagement surface 114 is provided along an upper surface of opening 103 of main portion 102. Surface 114 is proximate the free end of arm 104.

Figure 8:
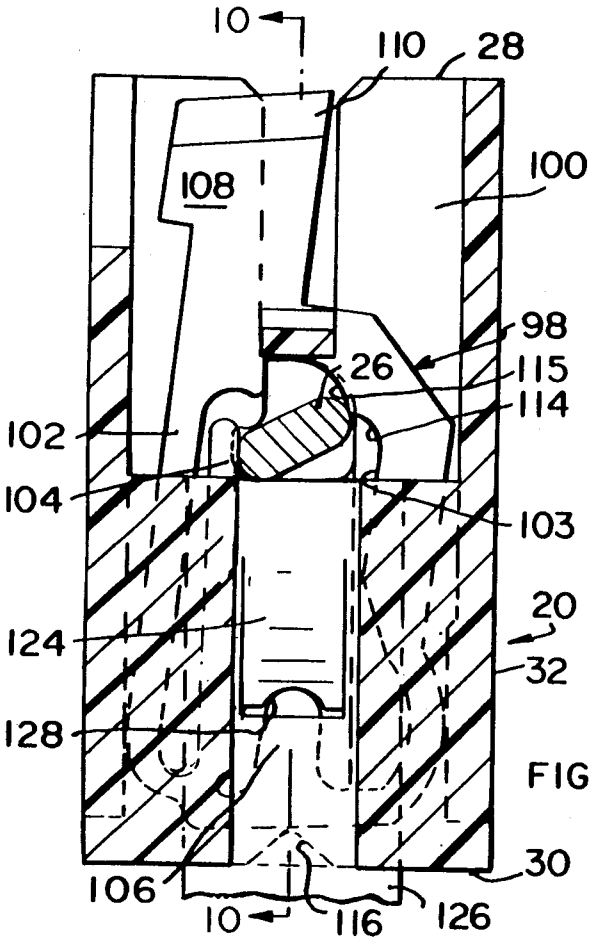
FIG. 8 is an orthographic cross-sectional view looking in the direction of arrows 8—8 of FIG. 11 illustrating the locking key in the locked position.

A fulcrum 116 is provided at a bottom of each locking slot 100 on which key 98 rests, as best shown in FIG. 7. Fulcrum 116 is positioned directly below pivot member 106. A securing device 118 as shown in FIG. 11 extends along locking key 98 within slot 100 and comprises a leading end 122, a resilient section 124 below leading end 122, and a mounting means 126 below resilient section 124. Resilient section 124 has a recess 128 on its bottom surface (FIGS. 7 and 8).

Each locking key 98 is inserted into locking slot 100 after which actuator 26 is inserted into openings 27 and slot 95. The leading end 122 of securing device 118 is then inserted through opening 120 in mounting surface 30 and moved inward causing resilient section 124 to assume a fixed condition. As insertion continues, resilient section 124 passes pivot member 106, as shown in FIG. 10, allowing resilient section 124 to resume an unflexed position in engagement with pivot member 106. Leading end 122 then engages actuator 26 defining a stop position, causing securing device 118 to be locked in a position between actuator 26 and pivot member 106 as shown in FIG. 10. In this locked position, mounting means 126 of securing device 118 extends beyond mounting surface 30 in the form of a compliant section of the type shown and described in U.S. Pat. No. 4,186,982. This compliant section frictionally engages holes in panel 4 (FIG. 1), thereby allowing panel 4 to be frictionally mounted to mounting means 126 until wave soldering can take place.

When each securing device 118 is in the locked position as described, each locking key 98 is also locked in place (FIG. 10). Recess 128 of resilient section 124 engages the top of pivot member 106 and locks pivot member 106 between resilient section 124 and fulcrum 116, maintaining locking key 98 in position in slot 100.

Figure 12:
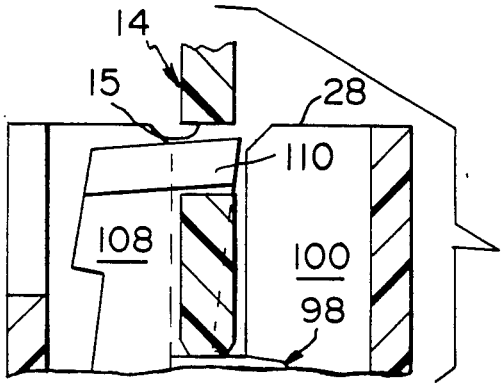
FIG. 12 is a fragmentary view of FIG. 10 showing a portion of the locking key in locking engagement with a portion of the substrate.
Figure 9:
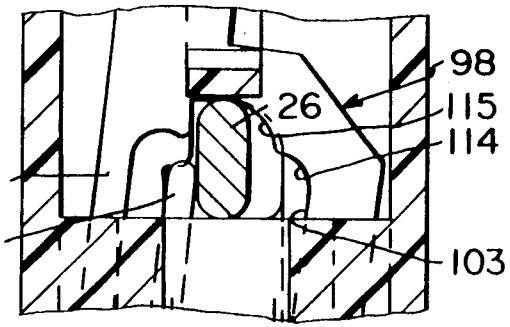
FIG. 9 is a fragmentary view of FIG. 8 showing the locking key maintained in the locked position.

With all parts secured in position, actuator 26 is moved engaging arcuate actuator engagement surfaces 114 causing locking keys 98 to radially move about pivot member 106. Locking keys 98 are moved from an unlocked position as shown in FIG. 7 to a locked position as shown in FIG. 8. In this locked position, ear portions 110 are positioned in slots 15 of substrate 14 as shown in FIG. 12. The unlocked position corresponds to the first position of actuator 26 as shown in FIG. 3. However, the ear portions 110 must engage substrate 14 before the second position of actuator 26 (FIG. 5) is reached. The substrate must be held in place as contact surfaces 64 are moved across terminal pads 12 in order to insure that optimal wipe occurs. This is accomplished by the configuration of the actuator engagement surfaces 114 and 115. The design of surfaces 114 allow the locking keys 98 to be radially moved such that the locking position as shown in FIG. 8 is reached before contact surfaces 64 are moved across terminal pads 12. Locking keys 98 are maintained in this locking position as actuator 26 is moved along surfaces 115 to the second position (FIGS. 8 and 9).

To disengage locking keys 98 and terminals 22 from substrate 14, actuator 26 is moved clockwise from the second position to the first position. Arms 104 of locking keys 98 are thereby engaged by actuator 26 causing locking keys 98 to be moved from the locked position to the unlocked position. As actuator 26 is being moved clockwise, actuator 26 engages surfaces 98 thereby moving camming block 24 downwardly causing terminals 22 to resume a flexed condition in which contact arms 60 are disengaged from substrate 14, as shown in FIG. 3. Therefore, when actuator 26 is in the first position, substrate 14 can be easily removed from the connector assembly.

This invention allows for easy insertion of a substrate into the connector assembly with the significant advantage of allowing a wipe action to occur, thereby assuring a positive electrical connection. Contact surfaces 64 are moved across terminal pads 12 as contact arms 60 exert normal contact force on the terminal pads. This optimal wipe is a direct result of the unique terminals 22 which are designed so that pivot portions 72 allow radial movement of the contact arms relative to shanks 48. Locking keys 98 are also provided to hold the substrate in place as the wipe occurs. This coordinated action assures that the wipe takes place under ideal conditions and guarantees a positive electrical connection.

What is claimed is:

1. An electrical connector comprising:

an insulating housing having a substrate-receiving surface and a mounting surface;

an opening extending into the substrate-receiving surface for reception of a substrate having spaced-apart terminal pads;

terminals positioned in the housing adjacent the opening having free ends which are proximate the substrate-receiving surface and fixed ends which are proximate the mounting surface, the terminals having thereon contact engagement cam followers and contact wipe cam followers;

contact arms extending from the free ends toward the opening, the contact arms having outer ends, each outer end comprising a contact portion of the terminal and the contact wipe cam follower;

camming block means positioned in the opening which is movable between a first position and a second position;

an actuator provided in the housing for moving the camming block means between the first position and the second position;

contact engagement cam surface means integral with the camming block means being associated with, and adjacent to, the contact engagement cam followers, the contact engagement cam surface means and the contact engagement cam followers being effective, during movement of the camming block means from the second position to the first position, to flex the terminals away from the opening so that the contact portions of the terminals are moved away from the opening allowing the substrate to be placed in the opening under zero insertion force conditions, and upon movement of the camming block means back to the second position, the terminals are moved toward the substrate allowing the contact portions to move against the terminal pads, the contact portions are held resiliently urged against the terminal pads under normal force conditions; and contact wipe cam surface means integral with the camming block means being associated with, and proximate to, the contact wipe cam followers, the contact wipe cam surface means being engageable with the contact wipe cam followers during a final portion of the movement of the camming block means to the second position and being effective to move the contact portions over the terminal pads under normal force conditions producing clean contact surfaces at the electrical interfaces of the contact portions and the terminal pads.

2. An electrical connector as recited in claim 1, wherein at least one locking key is provided in the housing, the locking key being movable by the actuator between a locking position and an unlocked position, and the locking key being in locking engagement with the substrate when in the locking position and being effective thereby to prevent movement of the substrate during movement of the contact portions of the terminal across the terminal pack.

3. An electrical connector as recited in claim 1, wherein each terminal is stamped and formed from a resilient sheet metal stock, each terminal having a contact arm struck from the free end, the contact arm has an inner end which is pivotally attached to the free end of the terminal, an outer end is opposite the inner end and has the contact portion and contact wipe cam follower adjacent to it, enabling the outer end of the contact arm to move about the free end of the terminal.

4. An electrical connector as recited in claim 1, wherein the camming block means has a channel extending through it, the channel having surfaces of recesses and actuator engagement surfaces which cooperate with the actuator to move the camming block means between the first position and the second position.

5. An electrical connector comprising:

insulating housing means having a substrate-receiving surface and a mounting surface;

an opening extending into the substrate-receiving surface for reception of a substrate having spaced-apart terminal pads, the opening having opposed opening sidewalls;

terminal-receiving cavities extending into the opening sidewalls;

terminals positioned in the terminal-receiving cavities of the housing means, the terminals having free ends which are proximate the substrate-receiving surface and fixed ends which are proximate the mounting surface, the terminals having thereon contact engagement cam followers and contact wipe cam followers;

contact arms extending from the free ends toward the opening, the contact arms having outer ends, each outer end comprising a contact portion of the terminal and the contact wipe cam follower;

camming block means positioned in the opening and being movable from a first position to a second position, the camming block means having contact engagement cam surface means and a plurality of contact wipe cam surfaces, the contact engagement cam surface means and the contact wipe cam surfaces being associated with respective contact engagement cam followers and contact wipe cam followers of the terminals;

each contact wipe cam surface being engageable with the contact wipe cam follower of its associated terminal during a final portion of the movement of the camming block means to the second position and being effective to move the contact portion over the terminal pad under normal force conditions, whereby upon placement of a substrate in a substrate-receiving opening with the camming block means in the first position and upon subsequent movement of the camming block means to the second position, the contact engagement cam surface means cooperates with the terminals to allow the contact portions of the terminals to be brought into contact with the terminal pads on the substrate, the contact portions are then moved over the terminal pads thereby producing clean contact surfaces at the electrical interfaces of the contact portions and the terminal pads.

6. An electrical connector as recited in claim 5 wherein substrate locking means are provided in the housing means for locking the substrate to the housing means and preventing movement of the substrate from the housing means during movement of the contact portions across the terminal pads, the substrate locking means having locking portions which engage the substrate when the terminals are partly unflexed.

7. An electrical connector as recited in claim 6 wherein the substrate locking means comprises at least one locking key in the housing means which is movable between a locking position and an unlocked position, the substrate being locked to the housing means when the key is in the locking position.

8. An electrical connector as recited in claim 7 wherein an actuator is provided for moving the locking key between the locking position and the unlocked position and for moving the camming block means.

9. An electrical connector comprising:

insulating housing means having a substrate-receiving surface and a mounting surface;

an opening extending into the substrate-receiving surface for reception of a substrate having spaced-apart terminal pads, the opening having opposed opening sidewalls;

terminal-receiving cavities extending into the opening sidewalls;

terminals positioned in the terminal-receiving cavities of the housing means, the terminals having free ends which are proximate the substrate-receiving surface and fixed ends which are proximate the mounting surface, the terminals having thereon contact engagement cam followers and contact wipe cam followers;

contact arms extending from the free ends toward the opening, the contact arms having arcuate shaped outer ends, each outer end comprising a contact portion of the terminal and the contact wipe cam follower;

camming block means positioned in the opening and being movable from a first position to a second position, the camming block means having contact engagement cam surface means and a plurality of contact wipe cam surfaces, the contact engagement cam surface means and the contact wipe cam surfaces being associated with respective contact engagement cam followers and contact wipe cam followers of the terminals;

the contact engagement cam surface means and associated contact engagement cam followers being effective, during movement of the camming block means from the second position to the first position, to flex the associated terminal away from the opening so that the contact portion of the terminal is moved away from the opening and a substrate can be placed in the opening under reduced insertion force conditions, and upon movement of the camming block means back to the second position, the associated terminal is moved toward the substrate and the contact portion moves against the terminal pad, and the contact portion is held resiliently urged against the pad under normal force conditions;

each contact wipe cam surface being engageable with the contact wipe cam follower of its associated terminal during a final portion of the movement of the camming block means to the second position and being effective to move the contact portion over the terminal pad under normal force conditions; whereby upon placement of a substrate in the substrate-receiving opening with the camming block means in the first position and upon subsequent movement of the camming block means to the second position, the contact portions of the terminals are brought into contact with the terminal pads on the substrate, and the contact portions are then moved over the terminal pads and clean contact surfaces are produced at the electrical interfaces of the contact portions and the terminal pads.

10. An electrical connector as recited in claim 9, wherein an actuator is provided in the insulating housing means for moving the camming block means, between the first and second positions.

11. An electrical connector as recited in claim 10, wherein the actuator is a rod which when turned moves the camming block means from the first position to the second position.

12. An electrical connector as recited in claim 9, wherein the contact engagement cam follower is between the fixed end of the terminal and the free end of the terminal.

13. An electrical connector as recited in claim 9 characterized in that at least one locking key is provided in the housing means, the locking key being movable between a locking position and an unlocked position, the locking key being in engagement with a substrate in the opening when in the locking position and being effective thereby to prevent movement of the substrate from the opening during movement of the contact portions of the terminals across the terminal pads.

14. An electrical connector as recited in claim 13, characterized in that the locking key has an ear portion which is received in an opening in the substrate when the locking key is in the locking position.

15. An electrical connector as recited in claim 14, characterized in that the locking key is moved between the locking position and the unlocked position by an actuator rod, the locking key being in the unlocked position when the camming block means is in the first position.

16. An electrical connector as recited in claim 14, characterized in that a pair of locking keys are provided, each of the locking keys being adjacent to one of the endwalls of the housing means so that a substrate positioned in the opening is between the locking keys, the ear portions on the locking keys being dimensioned to enter notches in the substrate.

* * * * *